US009776823B2

(12) United States Patent
Yamada

(10) Patent No.: US 9,776,823 B2
(45) Date of Patent: Oct. 3, 2017

(54) LABEL ISSUING DEVICE INCLUDING ANTI-ADHESIVE AGENT RESERVOIR

(71) Applicant: TERAOKA SEIKO CO., LTD., Tokyo (JP)

(72) Inventor: Tsutomu Yamada, Tokyo (JP)

(73) Assignee: TERAOKA SEIKO CO., LTD., Tokyo (JP)

( * ) Notice: Subject to any disclaimer, the term of this patent is extended or adjusted under 35 U.S.C. 154(b) by 271 days.

(21) Appl. No.: 14/489,829

(22) Filed: Sep. 18, 2014

(65) Prior Publication Data

US 2015/0083844 A1 Mar. 26, 2015

(30) Foreign Application Priority Data

Sep. 20, 2013 (JP) ..... 2013-195693
Aug. 9, 2014 (JP) ..... 2014-163255

(51) Int. Cl.
*B26D 1/08* (2006.01)
*B26D 7/08* (2006.01)
*B65H 35/00* (2006.01)

(52) U.S. Cl.
CPC ... *B65H 35/0026* (2013.01); *B65H 2701/192* (2013.01); *B65H 2801/75* (2013.01)

(58) Field of Classification Search
CPC ..... B65H 35/0026; B65H 2701/192; B65H 2801/75
See application file for complete search history.

(56) References Cited

U.S. PATENT DOCUMENTS 1,700,275 A * 1/1929 Willett ..... B27B 13/12 184/64
5,302,037 A * 4/1994 Schoendienst ..... B41J 11/48 242/129.51
5,561,003 A * 10/1996 Nowosiadly ..... B60R 13/0206 296/93
5,911,849 A * 6/1999 Bradshaw ..... B26D 7/088 118/243

(Continued)

FOREIGN PATENT DOCUMENTS

JP 62-1899 1/1987
JP 2012-192955 * 10/2012 ..... B65C 9/08

(Continued)

*Primary Examiner* — Matthew G Marini
*Assistant Examiner* — Marissa Ferguson Samreth
(74) *Attorney, Agent, or Firm* — Greenblum & Bernstein, P.L.C.

(57) ABSTRACT

The label issuing device, which reels out linerless paper having an adhesive face on one side and cuts the reeled-out linerless paper to issue individual labels, has a cutter part for cutting the reeled-out linerless paper and a detachable container that is detachable from an enclosure of the label issuing device. The detachable container has a reservoir part for reserving a lubricant, and an application part that extends from the reservoir part, receives the lubricant reserved in the reservoir part, and applies the lubricant to a blade body of the cutter part. The reservoir part is filled with an impregnation material that is impregnated with the lubricant to hold (reserve) the lubricant, wherein the impregnation material is coupled to an impregnation material of the application part.

10 Claims, 10 Drawing Sheets

(56) References Cited

U.S. PATENT DOCUMENTS

| | | | | | |
|---|---|---|---|---|---|
| 6,026,824 | A * | 2/2000 | Gueret | A45D 40/267 | 132/218 |
| 6,145,561 | A * | 11/2000 | Watanabe | B26D 1/0006 | 156/517 |
| 6,155,732 | A * | 12/2000 | Plasschaert | B26D 1/085 | 400/621 |
| 6,394,675 | B1 * | 5/2002 | Sodeyama | B41J 3/4075 | 400/208 |
| 6,732,626 | B2 * | 5/2004 | Hong | B26D 7/088 | 221/30 |
| 6,994,932 | B2 * | 2/2006 | Kinkelaar | H01M 8/04208 | 429/447 |
| 7,604,426 | B2 * | 10/2009 | Hanaoka | B26D 5/14 | 400/611 |
| 7,806,361 | B2 * | 10/2010 | Sato | B65H 16/02 | 242/595 |
| 8,882,011 | B2 * | 11/2014 | Romanovich | B02C 18/0007 | 241/100 |
| 8,888,388 | B2 * | 11/2014 | Mochida | B26D 1/0006 | 400/621 |
| 2003/0230181 | A1 * | 12/2003 | Hong | B26D 7/088 | 83/649 |
| 2009/0180826 | A1 * | 7/2009 | Guay | A45D 34/04 | 401/197 |

FOREIGN PATENT DOCUMENTS

| | | | | |
|---|---|---|---|---|
| JP | 2012-192956 | * | 10/2012 | B65C 9/18 |
| JP | 2014104567 | * | 11/2012 | B26D 7/08 |
| JP | 2012-250718 | * | 12/2012 | B65C 9/18 |
| JP | 2014-104567 | * | 6/2014 | B26D 7/08 |
| JP | 2015-009514 | * | 1/2015 | B41J 11/70 |
| JP | 2015-150105 | * | 1/2015 | B41J 11/70 |
| JP | 2015-62986 | * | 4/2015 | B26D 1/08 |

* cited by examiner

LABEL ISSUING DEVICE INCLUDING ANTI-ADHESIVE AGENT RESERVOIR

TECHNICAL FIELD

The present invention relates to a label issuing device that reels out a roll of linerless paper and cuts the reeled-out linerless paper with a cutter part to issue individual labels, and relates to a detachable container for the label issuing device.

RELATED ART

A roll of linerless paper used in a label issuing device is created by rolling long linerless paper that has an adhesive face with an adhesive to be stuck on an article and the like. The label issuing device reels out this roll of linerless paper and cuts this reeled-out linerless paper with a cutter part to issue individual labels.

In a case where this label issuing device issues labels continuously, the adhesive applied to the adhesive face of the linerless paper adheres to a blade body of the cutter part, resulting in poor cutting of the linerless paper by the cutter part. For the purpose of preventing adhesion of the adhesive of the adhesive face of the linerless paper to the blade body of the cutter part, a mechanism for applying a lubricant such as oil to the blade body of the cutter part is provided (see Patent Document 1).

A maintenance method for such label issuing device for supplying the lubricant to a reservoir part (liquid-retaining material) is required to, for example, remove a cover and the reservoir part (liquid-retaining material) fixed to a cover inner surface and impregnated with the lubricant (anti-adhesive liquid), and then impregnate the reservoir part (liquid-retaining material) on the cover inner surface with the lubricant (anti-adhesive liquid) using some kind of a method.

CITATION LIST

Patent Documents

[Patent Document 1] Japanese Utility Model Application Publication No. S62-1899

SUMMARY OF THE INVENTION

Unfortunately, such a conventional label issuing device in which a lubricant such as oil is supplied to the blade body of the cutter part has a problem in that the maintenance work for supplying the lubricant (anti-adhesive liquid) becomes time-consuming because the reservoir part (liquid-retaining material) is fixed to the cover inner surface. Furthermore, because the mechanism for applying a lubricant such as oil to the blade body of the cutter part is installed in a label issue port separately from the device, the device itself becomes large in size.

The present invention has been made in light of the foregoing problems, and objects thereof are to simplify the operation of maintaining favorable cutting performance of the blade body of the cutter part to cut linerless paper, which has an adhesive face on one side, and to provide a label issuing device that has a structure to simplify such maintenance operation, as well as a to provide a detachable container for the label issuing device.

In order to achieve this object, a label issuing device according to the present invention at least has the following configurations.

A label issuing device that reels out linerless paper having an adhesive face on one side and cuts the reeled-out linerless paper with a cutter part to issue labels, the label issuing device having:

a detachable container that is detachable from an enclosure of the label issuing device, wherein the detachable container has:

a reservoir part for reserving an anti-adhesive agent; and an application part that extends from the reservoir part, receives the anti-adhesive agent reserved in the reservoir part and applies the anti-adhesive agent to a blade body of the cutter part.

In the label issuing device according to the present invention, it is preferred that the reservoir part of the detachable container be positioned along a paper feeding direction of the linerless paper.

The enclosure of the label issuing device according to the present invention has a main unit part and a cover part, wherein one end portion of the cover part is pivotally supported by the main unit part to be rotatable, while an open end, which is the other end portion of the cover part, is provided to be engaged freely with the main unit part, a fixed blade of the cutter part is provided in the cover part, while a movable blade of the cutter part is provided in the main unit part, and the detachable container is provided detachably on the open end side of the cover part and in the vicinity of the fixed blade.

In the label issuing device according to the present invention, it is preferred that the application part be positioned between the fixed blade of the cutter part disposed along a direction perpendicular to the paper feeding direction, and an application part support part of the detachable container disposed parallel to the fixed blade of the cutter part.

The label issuing device according to the present invention has a supply route part that has one open end communicated to the reservoir part and supplies the lubricant from the other open end of the supply route part facing the one open end, wherein the other open end of the supply route part is located above the one open end in a perpendicular direction to be opened to the outside of the label issuing device.

In the label issuing device according to the present invention, the other open end of the supply route part is provided either in an upper end portion of the cover part that is opened/closed when replacing the linerless paper or in an upper end portion of the enclosure of the label issuing device.

In the label issuing device according to the present invention, the other open end of the supply route part is provided in the vicinity of the reservoir part.

The label issuing device according to the present invention is provided with a cap part for opening/closing the other open end of the supply route part.

A detachable container according to the present invention is the detachable container for the label issuing device according to the present invention.

The present invention can simplify the operation of maintaining favorable cutting performance of the blade body of the cutter part to cut linerless paper, which has an adhesive face on one side, and to provide a label issuing device that has a structure to simplify such maintenance operation.

More specifically, the label issuing device of the present invention has the detachable container provided with the reservoir part for reserving a lubricant (anti-adhesive liquid or anti-adhesive agent) and the application part for applying the lubricant to the blade body of the cutter part, wherein the lubricant such as oil can easily be applied to the blade body of the cutter part. This label issuing device can easily replace the detachable container, thus facilitating the maintenance work.

In addition, the lubricant can easily be introduced from the other open end of the supply route part, and a required amount of lubricant can be reserved in the reservoir part. Therefore, the label issuing device provided by the present invention can simplify the maintenance work for achieving good cutting performance of the blade body of the cutter part without having the need to replace a cartridge and the like.

The present invention can also provide a detachable container for the label issuing device.

BRIEF DESCRIPTION OF THE DRAWINGS

FIG. 7 is a top view showing an example of the detachable container, a fixed blade, a movable blade, and the like;

FIG. 9A is a diagram showing an example of a state in which the movable blade and the application part are separated from each other, and FIG. 9B is a diagram showing an example of a state in which the movable blade and the application part are in contact with each other; FIG. 10A is a diagram showing an example of a state in which the movable blade and the application part are separated from each other, and FIG. 10B is a diagram showing an example of a state in which the movable blade and the application part are in contact with each other.

DETAILED DESCRIPTION OF PREFERRED EMBODIMENTS

Embodiments of the present invention are described hereinafter in detail with reference to the accompanying drawings.

Embodiments

Figure 1:
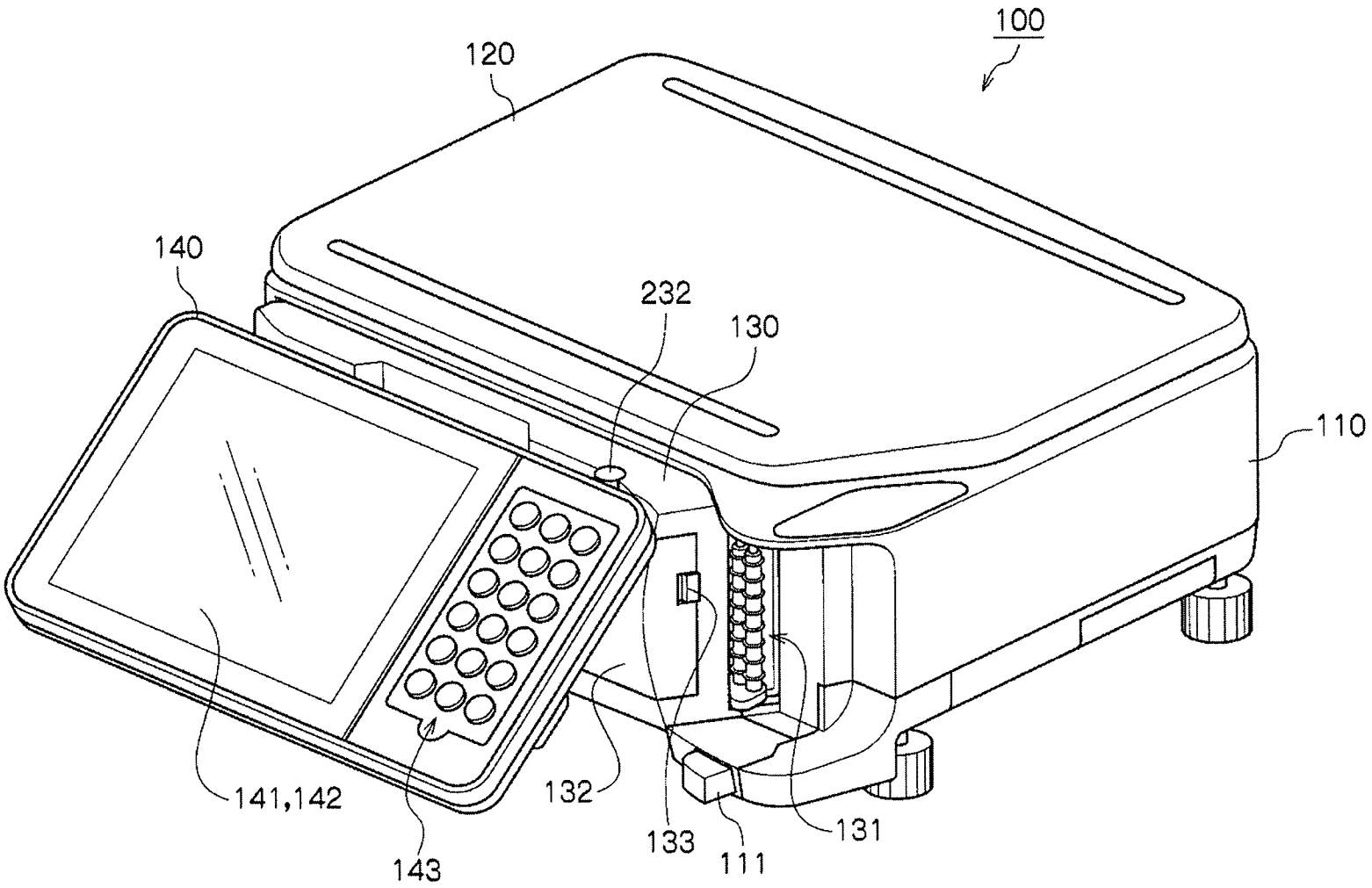
FIG. 1 is a schematic perspective view showing a label issuing device according to an embodiment of the present invention.

FIG. 1 is a schematic perspective view showing a label issuing device according to an embodiment of the present invention. A label issuing device 100 according to this embodiment measures the mass (weight) of a measured object (not shown), and issues a label printed with a plurality of predetermined print items such as the measured value (weighed value), item of the measured object, price of the same, and the like.

This label issuing device 100 reels out a roll of long linerless paper (linerless label paper) and uses it as printing paper. This linerless paper (FIG. 7 Linerless paper 11) has an adhesive face for sticking labels to the measured objects and the like, the adhesive face being created by, for example, applying an adhesive (glue) to a rear surface of heat-sensitive paper. The labels are issued in the following manner.

In this case, therefore, print information containing the plurality of predetermined print items is printed out on a printing surface (front surface) of the linerless paper using a printing part (not shown) configured by a thermal head and platen roller, and then the linerless label paper is cut with a cutter part (FIG. 8 cutter part 5), to issue individual labels.

A possible problem in cutting the linerless paper with the cutter part is that when the adhesive applied to the rear surface of the linerless paper adheres to a blade body that is an element of the cutter part for cutting the linerless paper, the linerless paper might not be able to be cut smoothly thereafter. In order to cope with this problem, a lubricant (ant-adhesive agent) such as oil is applied to the front surface of the blade body each time when cutting the linerless paper, to prevent the adhesion of the adhesive.

The cutter part is used for cutting linerless paper by a shearing action, and the blade body of the cutter part is configured by a fixed blade and a movable blade that face each other with the linerless paper there between. Moving the movable blade toward the fixed blade causes shearing force to act on the linerless paper between the fixed blade and the movable blade, thereby cutting the linerless paper. The lubricant (anti-adhesive agent) for preventing adhesion of the adhesive is usually applied to the movable blade but may be applied to the fixed blade as well.

An application mechanism (FIG. 7 application part 240) for applying the lubricant (anti-adhesive agent) has a reservoir part for reserving the lubricant (anti-adhesive agent), an application part for applying the lubricant to the blade body of the cutter part, and a member for guiding the lubricant reserved in the reservoir part to the application part. The member for guiding the lubricant reserved in the reservoir part to the application part can be omitted by using, as the application part, a member such as a non-woven fabric that allows the lubricant to penetrate therein and transfers the lubricant to a part that is not soaked with the lubricant.

As shown in FIG. 1, the label issuing device 100 has an enclosure having a main unit part 110, a cover part 130 and the like. A placing table 120 for placing a measured object is provided on an upper surface of the main unit part 110 of the enclosure of the label issuing device 100. The main unit part 110 is provided with a mass sensor (not shown) that uses a strain gauge or the like to measure the mass of the measured object placed on the placing table 120.

Furthermore, as shown in FIG. 1, a left side surface of the main unit part 110 is provided with the cover part 130 of the enclosure for opening/closing the side surface. This cover part 130 is provided with a plate-like operation display part 140. The cover part 130 is provided with the operation display part 140, with a coupling mechanism (FIG. 2 supply route part 230), which is capable of defining an elevation angle of the operation display part 140 at any angle, being disposed between the cover part 130 and the operation display part 140. Therefore, an operator can hold the operation display part 140, set the elevation angle of the operation display part 140 to have a better view thereof, and keep the operation display part 140 in this state. Moreover, a label issue port 131 for discharging the labels issued as described above is provided between the cover part 130 and the main unit part 110.

The operation display part 140 is provided with an image display device 141 for displaying various types of information to the operator. A touch panel device 142 is provided on a display screen of this image display device 141 to allow the operator to operate an operation target displayed on the image display device 141. A hard key part 143 for inputting previously-set operation contents is provided to the right-hand side of the image display device 141 and touch panel device 142.

An operation lever 111 for disengaging the cover part 130 from the main unit part 110 is provided in a front-side lower portion of the left side surface of the main unit part 110. Operating this operation lever 111 in a disengaging direction can cancel the engagement between the cover part 130 and the main unit part 110 made by an engaging mechanism (not shown), move the cover part 130 to an opening direction, and open the left side surface of the main unit part 110. As a result of opening the cover part 130 in this manner, an accommodating part (not shown) for accommodating the linerless paper therein is exposed, and the linerless paper can be set therein.

Here, a transporting mechanism for transporting the linerless paper, the printing part for printing the information on the linerless paper, and the cutter part for cutting the linerless paper have partial components thereof disposed on the front surface side and rear surface side of the linerless paper in such a manner as to sandwich the linerless paper, wherein the configuration comprising the transporting mechanism, printing part and cutter part is completed by closing the main unit part 110 with the cover part 130.

Some of the components of these mechanisms are attached to the cover part 130. For example, the cutter part has its fixed blade provided in the cover part 130 and its movable blade provided in the main unit part 110. The fixed blade and the movable blade face each other to configure the cutter part when the cover part 130 is closed. The cover part 130 is also provided with the application mechanism for applying the lubricant.

A left side surface of the cover part 130 is provided with a door part 132 for exposing the internal structure of the cover part 130. An opening/closing lever 133 is an operation element for opening/closing the door part 132. Another open end 232 (described hereinafter) of a supply route part 230 (described hereinafter) for supplying the lubricant to the reservoir part is provided in an upper portion of the cover part 130.

Note that the main unit part 110 has a controller and the like for measuring the mass of the measured object placed on the placing table 120, creating print information to be printed on the linerless paper, controlling a printing operation for printing print information on the linerless paper, executing an input operation for displaying information on or inputting operation information to the operation display part 140, causing the cutter part to cut the linerless paper, and controlling the operation of each part of the label issuing device 100. However, the descriptions of the controller and the like are omitted as they are not related directly to the present invention.

Figure 2:
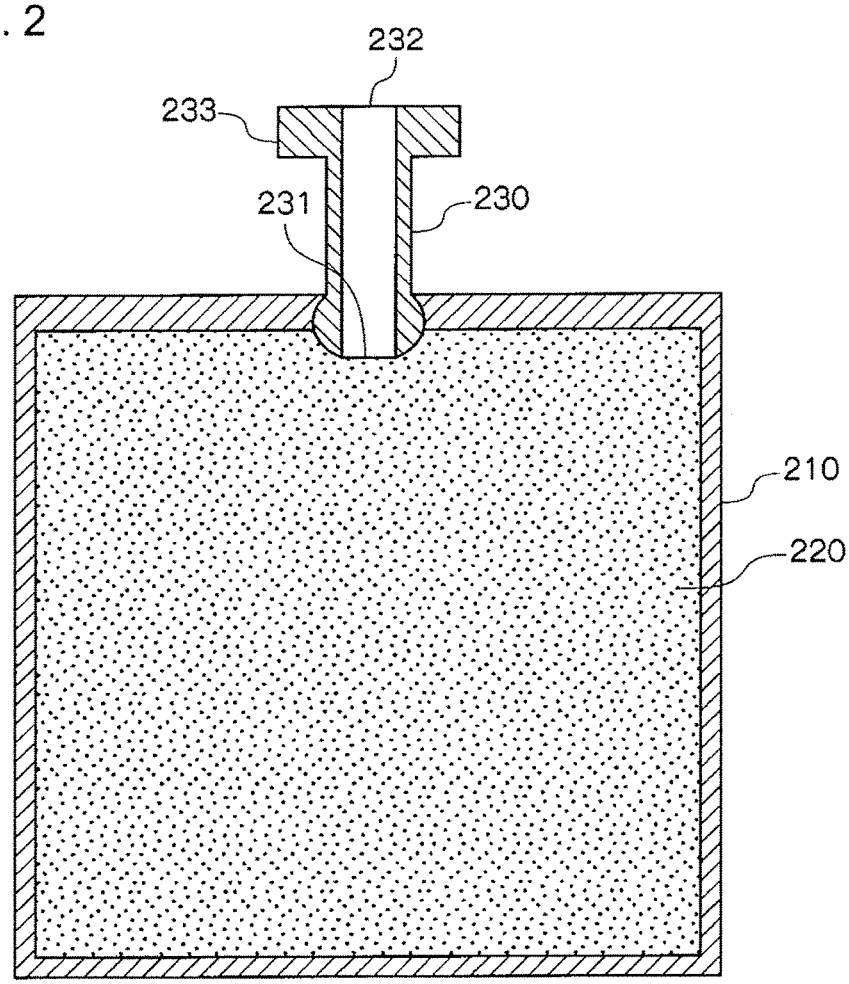
FIG. 2 is a schematic diagram showing an outline of a configuration of a reservoir part for reserving a lubricant (anti-adhesive agent) to be applied to a blade body of a cutter part for cutting linerless paper (linerless label paper)

FIG. 2 is a schematic diagram showing an outline of a configuration of the reservoir part for reserving the lubricant to be applied to the blade body of the cutter part for cutting the linerless paper.

As shown in FIG. 2, an impregnation material 220 that is impregnated with the lubricant to hold (reserve) the lubricant is accommodated in a reservoir part 210. A pipe-like supply route part 230 for supplying the lubricant to the reservoir part 210 is attached to an upper end of the reservoir part 210. Note that FIG. 2 shows the configuration in which the reservoir part 210 is filled with the impregnation material 220; however, the reservoir part 210 may not be completely filled with the impregnation material 220.

One open end 231 of the supply route part 230 is communicated to the inside of the reservoir part 210, while the other open end 232 of the supply route part 230 is located above the open end 231 in the perpendicular direction. The other open end 232 of the supply route part 230 is therefore provided at an upper end portion of the cover part 130 near the reservoir part 210. A rim part 233 is a member for latching the other open end 232 (FIG. 4 hole part 20*p*) to the upper end portion of the cover part 130.

Figure 5:
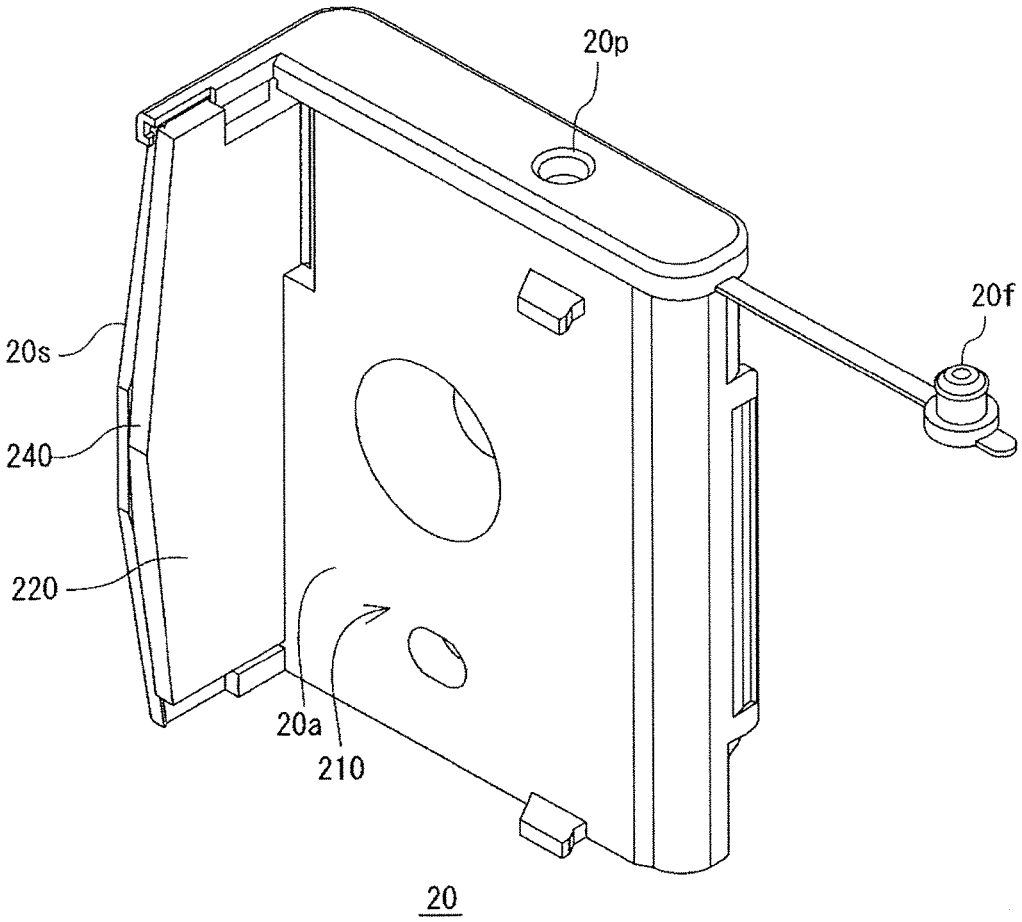
FIG. 5 is a perspective view of the detachable container (cartridge)

In a case where the other open end 232 is kept open, contaminants can enter the opening of this open end 232 which is exposed to the outside of the device. As a result, the supply route part 230 could be clogged with those contaminants. Therefore, it is preferred to provide a cover or the like (cap part; FIG. 5 cap part 20*f*) to open/close the opening of this other open end 232.

In a case where a cover or the like is mounted on the opening of the other open end 232 when supplying the lubricant to the reservoir part 210, this cover is removed first, to expose the opening of the other open end 232. Next, the lubricant is introduced into the opening of the other open end 232 by using an injector or the like.

Consequently, the lubricant is fed to the inside of the supply route part 230 at an injection pressure and then moves downward in the perpendicular direction by the action of gravity. Thus, the lubricant runs along an inner wall surface of the supply route part 230 to reach the one open end 231 and then the impregnation material 220 inside the reservoir part 210, penetrating into the impregnation material 220.

The lubricant can be supplied to the reservoir part 210 in this manner.

On the other hand, the application part for applying the lubricant to the blade body of the cutter part is provided along the length of a fixed blade, wherein the application part applies the lubricant to the movable blade by coming into contact with the movable blade when the movable blade is moved to cut linerless paper.

Furthermore, the application part has, for example, a non-woven fabric or the like that serves to transfer the lubricant as described above, and one of its end portions is provided along the length of the fixed blade and the other end portion is provided in such manner as to come into contact with the lubricant reserved in the reservoir part 210. The reservoir part 210 is provided with an opening (FIG. 2 other open end 232, FIG. 5 hole part 20*p*) that is roughly the size that allows the abovementioned other end portion of the application part to be inserted thereto. Inserting the other end portion of the application part into the reservoir part 210 through the opening can bring the other end portion of the application part into contact with the lubricant reserved in the reservoir part 210.

Consequently, the lubricant reserved in the reservoir part 210 is transferred from the other end portion of the application part to one end portion thereof in a penetrating manner. Then, the lubricant reaches the one end portion of the application part that is provided along the length of the fixed blade, and is thereby applied to the movable blade by the application part.

In other words, in such a case, the non-woven fabric or the like configuring the application part functions as a member for guiding the lubricant from the reservoir part 210 to the application part, as described above.

Incidentally, as described in the foregoing embodiment, the other open end 232 of the supply route part 230 is provided at the upper end portion of the cover part 130 in the vicinity of the reservoir part 210, but the position of the other open end 232 may be other than the upper end portion of the cover part 130 as long as it is above the one open end 231 of the supply route part 230 in the vicinity of the reservoir part 210 in the perpendicular direction. For instance, the other open end 232 may be provided at an upper end portion of the main unit part 110 or at a side end portion of the main unit part 110 or cover part 130.

In a case where the fixed blade of the cutter part is provided on the cover part 130 side and the movable blade of the cutter part is provided on the main unit part 110 side, workability in replacing the roll of linerless paper can be improved by expanding the space for installing the linerless paper (referred to as "paper installation space") when opening the cover part 130.

This paper installation space can be expanded by, for example, moving the movable blade in a direction opposite to the direction of opening the cover part 130 and toward the outside of the main unit part 110 which is a direction perpendicular to the direction of opening the cover part 130, when the operation lever 111 is operated and the cover part 130 is opened to disconnect the fixed blade and the movable blade.

Expanding the paper installation space in this manner facilitates the operation associated with replenishing a roll of linerless paper and keeps the movable blade in a place inaccessible to the operator who replenishes a roll of linerless paper, improving the safety of the device.

Furthermore, pushing the cover part 130 in its closing direction moves the movable blade in a direction opposite to the closing direction of the cover part 130, which is an inward direction of the device perpendicular to the closing direction, and causes a hook (not shown) provided on the fixed blade to draw a latching part (not shown) of the movable blade in an embracing manner to connect the fixed blade and the movable bade to each other, completing the configuration of the cutter part. The cutter part with such a configuration is fixed in a position and orientation suitable for cutting the linerless paper.

Figure 3:
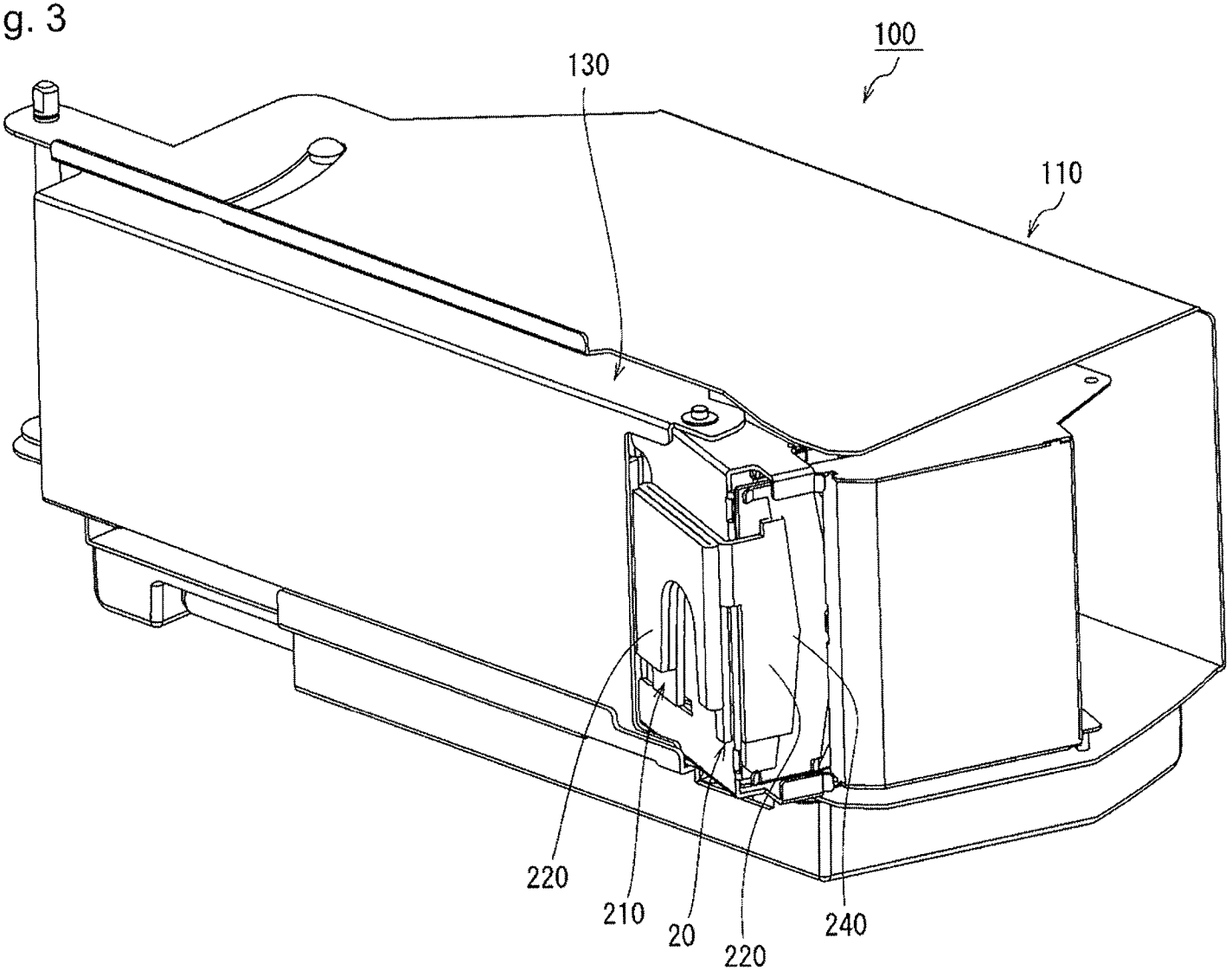
FIG. 3 is a schematic perspective view showing an example of the label issuing device without an exterior member.

FIG. 3 is a schematic perspective view showing an example of the label issuing device according to an embodiment of the present invention. Specifically, FIG. 3 shows an example of the label issuing device without an exterior member and the like.

Figure 4:
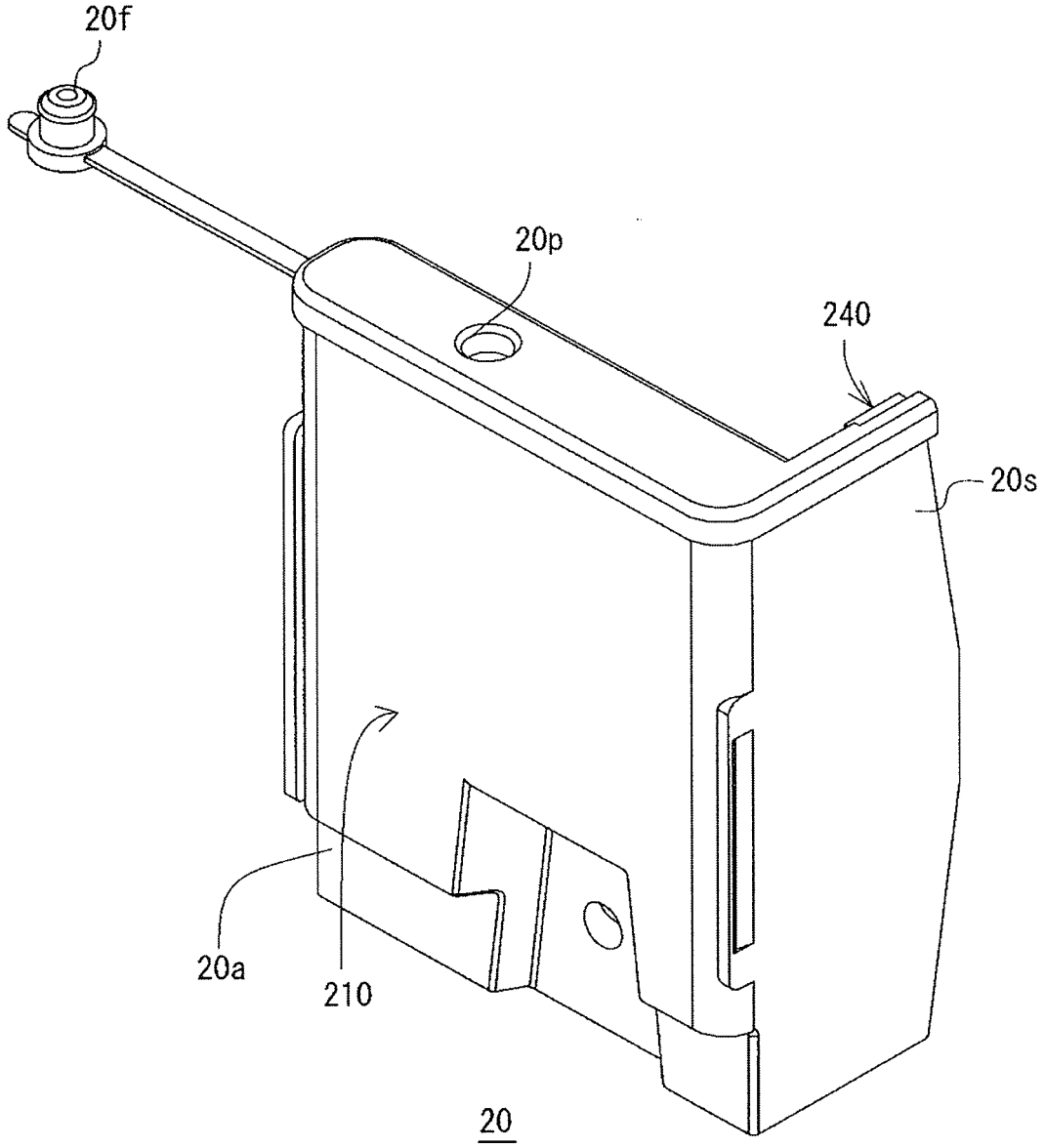
FIG. 4 is a perspective view of a detachable container (cartridge)
Figure 6:
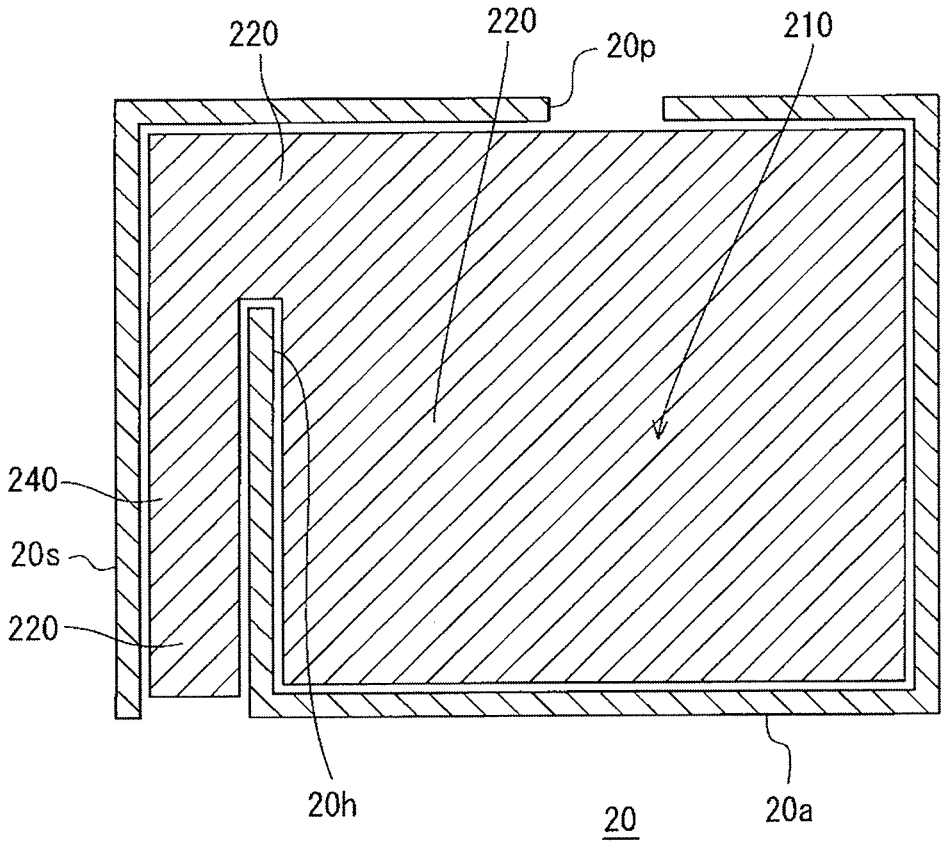
FIG. 6 is a perspective side view showing an example of the detachable container (cartridge)
Figure 7:
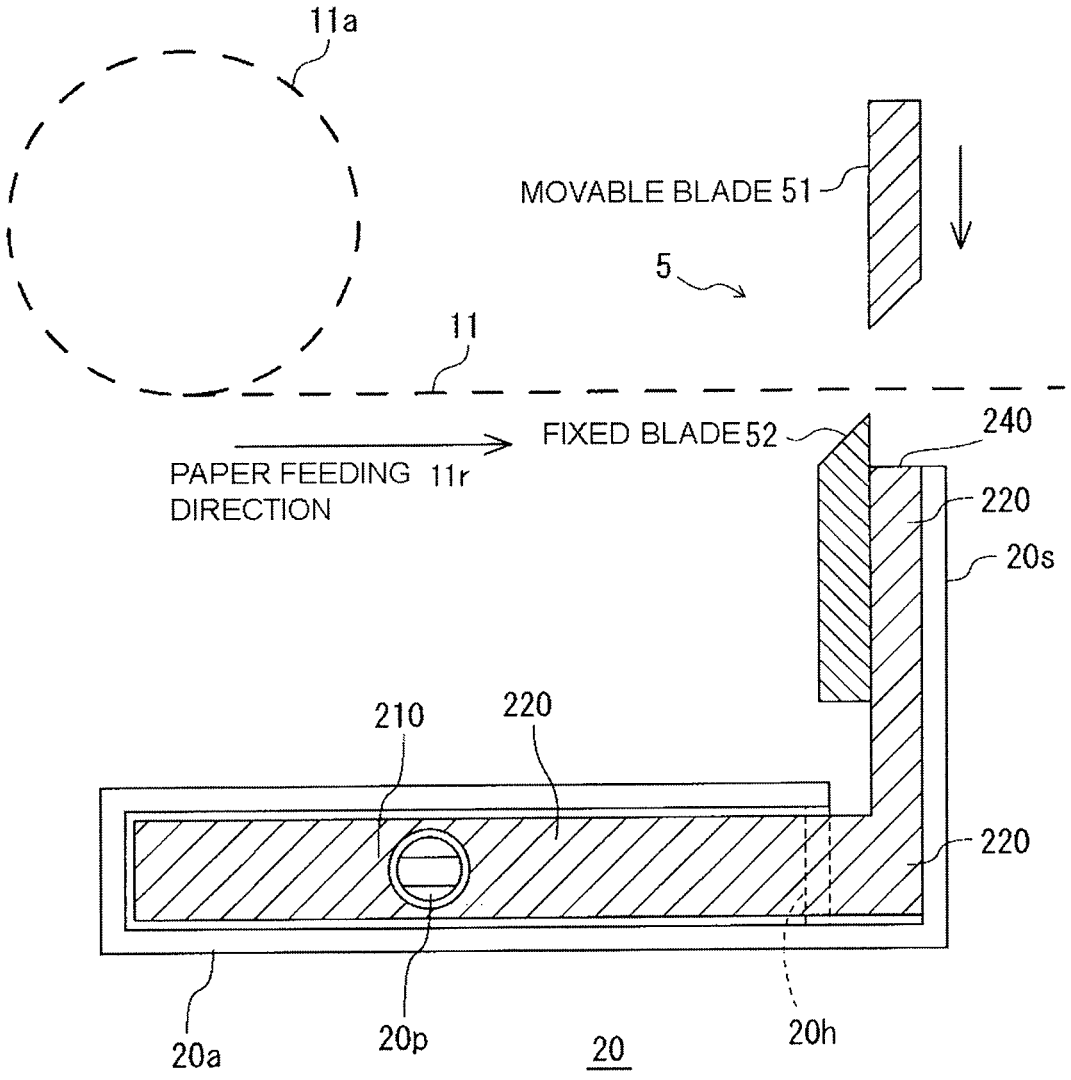
Figure 8:
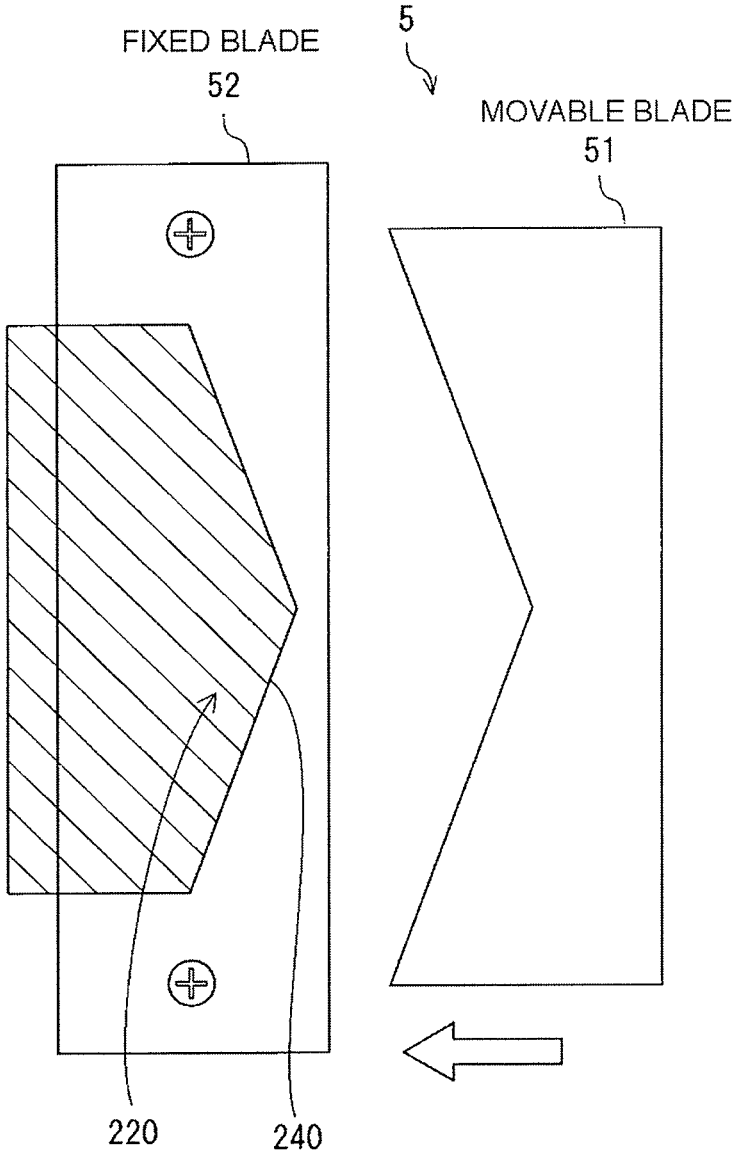
FIG. 8 is a diagram showing an example of the fixed blade, the movable blade, and an application part.

FIG. 4 is a perspective view of a detachable container (cartridge). FIG. 5 is a perspective view of the detachable container (cartridge). Specifically, FIG. 5 is a perspective view showing a part of an application part 240 from which the impregnation material 220 is exposed. FIG. 6 is a perspective side view showing an example of a detachable container 20 (cartridge). FIG. 7 is a top view showing an example of the detachable container 20, a cutter part 5 (fixed blade 52, movable blade 51) and the like. FIG. 8 is a diagram showing an example of the cutter part 5 (fixed blade 52, movable blade 51) and the application part 240.

The label issuing device has an enclosure with the main unit part 110 and the cover part 130. In the present embodiment, the label issuing device has a detachable container 20 (cartridge) that is provided detachably to the cover part 130 of the enclosure. The detachable container 20 has the reservoir part 210 for reserving a lubricant, the application part 240, and the like. The application part 240, extending from the reservoir part 210, receives the lubricant reserved in the reservoir part 210 and applies the lubricant to the blade body of the cutter part 5.

In the present embodiment, the detachable container 20 is in an L-shape as viewed from above. Specifically, the reservoir part 210 is disposed along a paper feeding direction 11*r* of linerless paper 11 reeled out of a roll 11*a* (a roll of linerless paper). The impregnation material 220 is accommodated in a case 20*a* of the reservoir part 210.

An application part support part 20*s* is provided in a container portion in the vicinity of the application part 240 provided in the detachable container 20. Specifically, the detachable container 20, which is in an L-shape as viewed from above, has the application part support part 20*s* extending in an orthogonal direction from an end portion of the case 20*a* of the reservoir part 210.

In the present embodiment, the fixed blade 52 of the cutter part 5 is disposed in a direction perpendicular to the paper feeding direction. The application part 240 is positioned between the fixed blade 52 of the cutter part 5 and the application part support part 20*s* of the detachable container 20 which is disposed parallel to the fixed blade 52. This application part 240 is configured by the impregnation material 220 and coupled to the impregnation material 220 accommodated in the case 20*a* of the reservoir part 210. The impregnation material 220 of the application part 240 is configured in such a manner as to be exposed to the outside of the container as shown in FIG. 5, and is disposed in abutment with the fixed blade 52 as shown in FIG. 7.

The detachable container 20 also has a partition part 20*h* between the reservoir part 210 and the application part 240, extending from a bottom portion to an upper portion of the case. An upper end portion of this partition part 20*h* and an upper part of the detachable container 20 are not connected to each other, but the impregnation material 220 of the application part 240 and the impregnation material 220 of the reservoir part 210 are coupled to each other.

The movable blade 51 of the cutter part 5 is configured to be able to move freely toward the fixed blade 52. In the present embodiment, the fixed blade 52 is in the shape of a flat plate. Both edges of a tip end portion of the movable blade 51 are formed to extend longer toward the fixed blade 52 than the center of the tip end portion.

The application part 240 is formed to conform to the shape of the tip end portion of the movable blade 51. In the present embodiment, the shape of a tip end of the application part 240 on the movable blade 51 side is defined into substantially a triangle.

The upper portion of the detachable container 20 is provided with a hole part 20*p*. This hole part 20*p* is provided with the abovementioned supply route part in a detachable manner. The configuration of the supply route part and the relationship between the supply route part and the other components are as described in the embodiment shown in FIGS. 1 and 2; thus, the descriptions thereof are omitted accordingly.

The detachable container 20 may also be provided with a cap part 20*f* that can be fitted freely into the hole part 20*p*. Fitting the cap part 20*f* into the hole part 20*p* can prevent leakage of the lubricant from the hole part 20*p* when, for example, replacing the used detachable container 20 with a new detachable container 20.

Next is described an example of the operations of the application part 240 configured by the impregnation material 220, and of the movable blade, fixed blade and the like of the cutter part.

Figure 9B:
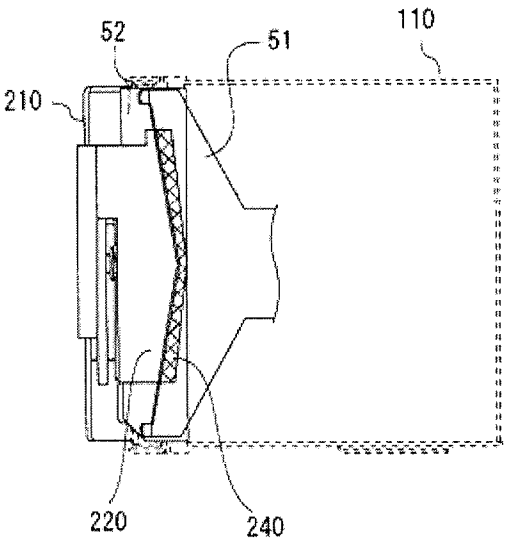
FIGS. 9A and 9B is a set of diagrams showing the application part, fixed blade and movable blade, where
Figure 9A:
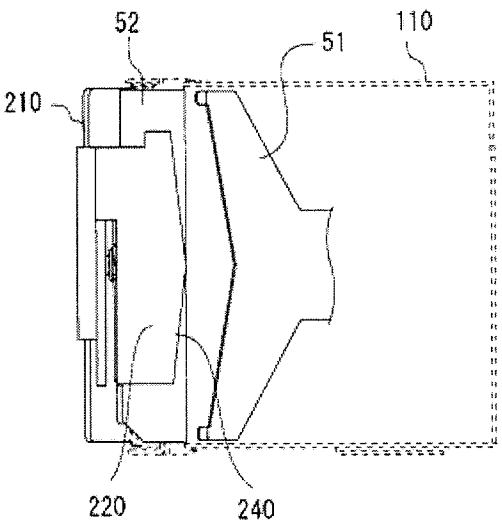

FIG. 9 is a set of diagrams showing an example of the application part 240, fixed blade 52, movable blade 51 and the like. Specifically, FIG. 9A is a diagram showing an example of a state in which the movable blade 51 and the application part 240 are separated from each other, and FIG. 9B is a diagram showing an example of a state in which the movable blade 51 and the application part 240 are in contact with each other.

In a state in which the movable blade 51 and fixed blade 52 of the cutter part 5 are separated from each other (see FIG. 9A), moving the movable blade 51 toward the fixed blade 52 generates shear force, which acts on the linerless paper between the fixed blade 52 and the movable blade 51, cutting the linerless paper. When the movable blade 51 and the application part 240 come into contact with each other, the lubricant is applied to the movable blade 51 (see FIG. 9B). In the present embodiment, the application part 240 and the cutter part 5 are configured in such a manner as to cause the application part 240 to apply the lubricant to the tip end portion of the movable blade 51 and the vicinity thereof.

Figure 10B:
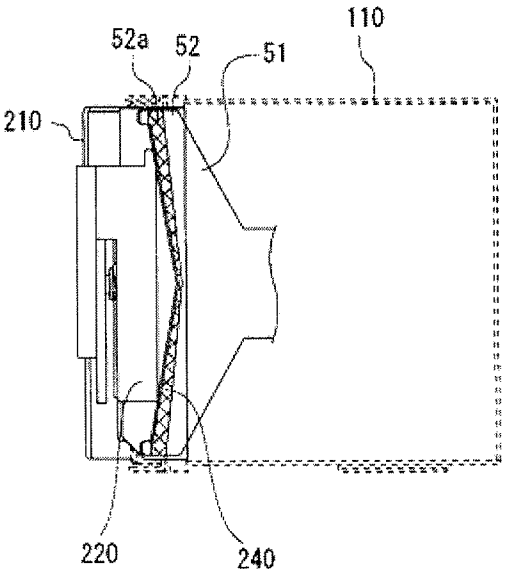
FIGS. 10A and 10B is a set of diagrams showing an example of the fixed blade, application part, and movable blade that are electrostatically flocked, where
Figure 10A:
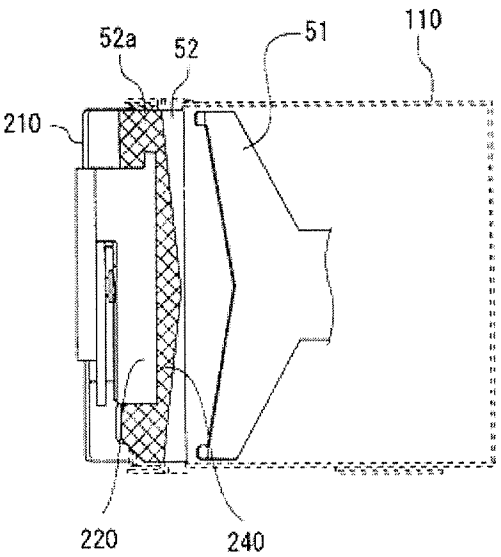

FIG. 10 is a set of diagrams showing an example of the fixed blade 52, application part 240, and movable blade 51 that are electrostatically flocked. Specifically, FIG. 10A is a diagram showing an example of a state in which the movable blade 51 and the application part 240 are separated from each other, and FIG. 10B is a diagram showing an example of a state in which the movable blade 51 and the application part 240 are in contact with each other. The differences between the present embodiment and the embodiment shown in FIG. 9 are now described.

In the present embodiment, the vicinity of the tip end portion of the fixed blade 52 is subjected to an electrostatic flocking process to configure an oil retaining body. Specifically, the fixed blade 52 (blade body) has a fiber part 52*a* that is formed by electrostatically flocking short fibers on a sliding contact surface of the fixed blade 52. This fiber part 52*a* is raised in a direction substantially perpendicular to the fixed blade 52 (blade body). This fiber part 52*a* is formed into, for example, a thickness of approximately 0.1 to 0.5 mm or preferably approximately 0.2 to 0.3 mm. In other words, the length of the short fibers is approximately 0.1 to 0.5 mm or preferably approximately 0.2 to 0.3 mm. When the short fibers are in the range of lengths described above, the fiber part 52*a* can provide favorable oil retentivity due to its capillary action.

In this manner, the lubricant from the impregnation material 220 is retained in the fiber part 52*a* due to its capillary action. In this state, the movable blade 51 comes into contact with the fiber part 52*a* formed in the fixed blade 52, applying the lubricant to the movable blade 51.

As described above, the label issuing device according to the embodiments of the present invention can reel out linerless paper having an adhesive face on one side, and cut the reeled-out linerless paper to issue individual labels. The label issuing device also has the cutter part 5 for cutting the reeled-out linerless paper. The label issuing device also has the detachable container 20 that can be detachable from the enclosure of the label issuing device.

The detachable container 20 has the reservoir part 210 for reserving an anti-adhesive agent (lubricant), and the application part 240, extending from the reservoir part 210, that receives the anti-adhesive agent (lubricant) reserved in the reservoir part 210 and applies the anti-adhesive agent (lubricant) to the blade body of the cutter part 5.

According to this configuration, a lubricant such as oil can easily be applied to the blade body of the cutter part 5 that cuts linerless paper having an adhesive face on one side.

Moreover, the label issuing device is configured to be able to easily replace the detachable container 20. Such a configuration can simplify the maintenance work for keeping good cutting performance of the cutter part 5. In addition, a label issuing device that is structured to simplify such maintenance work can be provided.

In the label issuing device according to the embodiments of the present invention, the reservoir part 210 of the detachable container 20 is positioned along the paper feeding direction 11*r* of the linerless paper 11. Owing to such a configuration, the detachable container 20 can be made small and thin.

The enclosure of the label issuing device according to the embodiments of the present invention has the main unit part 110 and the cover part 130. One of the end portions of the cover part 130 is pivotally supported by the main unit part 110 to be rotatable, while the open end, the other end portion of the cover part 130, is provided in such a manner as to be engaged freely with the main unit part. Also, the fixed blade of the cutter part 5 is provided in the cover part 130, while the movable blade of the cutter part 5 is provided in the main unit part 110. The detachable container 20 is provided detachably on the open end side of the cover part 130 near the fixed blade.

Such a configuration enables easy replacement of the detachable container 20.

In addition, the detachable container 20 of the label issuing device according to the embodiments of the present invention is formed into an L-shape as viewed from above, wherein the application part 240 is positioned between the fixed blade 52 of the cutter part 5 that is disposed along the direction perpendicular to the paper feeding direction of the linerless paper, and the application part support part 20*s* of the detachable container that is disposed parallel to the fixed blade 52 of the cutter part 5.

The detachable container 20 with the reservoir part 210 and application part 240 can therefore be made extremely small.

The label issuing device according to the embodiments of the present invention further has the supply route part that has one open end communicated to the reservoir part and supplies the lubricant from the other open end facing the one open end. The other open end of the supply route part is located above the one open end in the perpendicular direction and is opened to the outside of the device. This configuration allows the lubricant to be easily supplied to the reservoir part.

Moreover, in the configuration of the label issuing device according to the embodiments of the present invention, the other open end of the supply route part is provided either in the upper end portion of the panel part that opens/closes the enclosure when replacing the linerless paper or in the upper end portion of the enclosure. This configuration allows the lubricant to be easily supplied to the reservoir part.

Also in the configuration of the label issuing device according to the embodiments of the present invention, the other open end of the supply route part is provided in the vicinity of the reservoir part. This configuration allows the lubricant to be supplied to the reservoir part easily in a short period of time.

The label issuing device according to the embodiments of the present invention is also provided with the cap part for opening/closing the other open end of the supply route part. Leakage of the lubricant can easily be prevented by keeping the other open end of the supply route part closed with the cap part.

The present invention can be applied to any device as long as the device is a label issuing device that reels out a roll of linerless paper and cuts the reeled-out linerless paper with a cutter part to issue individual labels.

Furthermore, the detachable container 20 for the label issuing device can be provided.

Note that the configuration of each of the foregoing embodiments and modifications thereof can be employed in any appropriate combinations as long as no contradiction emerges as a result of the combinations.

The cutter part is not limited to the one described in the embodiments: thus, blade bodies of varied shapes such as a V-shaped blade, an angular tooth, and a flat blade can be employed as the cutter part.

EXPLANATION OF REFERENCE NUMERALS

5 . . . Cutter part
11 . . . Linerless paper
11*a* . . . Roll
11*r* . . . Paper feeding direction
20 . . . Detachable container (cartridge)
20*s* . . . Application part support part
51 . . . Movable blade
52 . . . Fixed blade
100 . . . Label issuing device
110 . . . Main unit part (enclosure)
111 . . . Operation lever
120 . . . Placing table
130 . . . Cover part (enclosure)
131 . . . Label issue port
210 . . . Reservoir part
220 . . . Impregnation material
230 . . . Supply route part
231 . . . One open end
232 . . . Other open end
233 . . . Rim part
240 . . . Application part

What is claimed is:

1. A label issuing device that reels out linerless paper having an adhesive face on one side to issue labels, the label issuing device comprising:

a cutter that cuts the reeled-out linerless paper, a blade body of the cutter configured by a fixed blade and movable blade that face each other with the linerless paper therebetween:

a reservoir that receives an anti-adhesive agent; and an impregnation material accommodated in the reservoir, the impregnation material coupling the reservoir with the fixed blade;

wherein the fixed blade includes an oil retaining body configured by a fiber part that extends in a direction substantially perpendicular to a major surface of the fixed blade, on a surface that comes into sliding contact with the movable blade, the impregnation material receiving the anti-adhesive agent is in constant contact with the oil retaining body provided on the fixed blade, whereby the anti-adhesive agent is retained in the oil retaining body, and the movable blade comes into contact with the oil retaining body provided on the surface of the fixed blade that comes into sliding contact with the movable blade upon cutting, whereby the anti-adhesive agent is applied to the movable blade.

2. The label issuing device according to claim 1, wherein the enclosure of the label issuing device has a main unit and a cover, one end portion of the cover is pivotally supported by the main unit to be rotatable, while an open end, which is another end portion of the cover is provided to be freely engaged with the main unit, the fixed blade, faces the movable blade of the cutter, is provided on the open end side of the cover, and the reservoir is provided on the open end side of the cover and in a vicinity of the fixed blade.

3. The label issuing device according to claim 1, further comprising:

a supply route that has one open end in communication with the reservoir and supplies the anti-adhesive agent from an other open end thereof facing the one open end, wherein the other open end of the supply route is located above the one open end in a perpendicular direction to be opened to outside of the label issuing device.

4. The label issuing device according to claim 3, wherein the other open end of the supply route is provided either in an upper end portion of a cover that is opened/closed when replacing the linerless paper or in an upper end portion of an enclosure of the label issuing device.

5. The label issuing device according to claim 3, wherein the other open end of the supply route is provided in a vicinity of the reservoir.

6. The label issuing device according to claim 3, further comprising a cap for opening/closing the other open end of the supply route.

7. The label issuing device according to claim 1, wherein the impregnation material in the reservoir comprises a first portion and a second portion extending transverse to the first portion, the second portion extending from the first portion in a plane of movement of the movable blade.

8. The label issuing device according to claim 1, wherein the impregnation material in the reservoir comprises a first portion and a second portion extending transverse to the first portion, an opening being provided a reservoir wall adjacent in the first portion and configured to be closed by a cap, the second portion extending from the first portion in a direction parallel to a major surface of the fixed blade.

9. The label issuing device according to claim 1, the oil retaining body of the fixed blade comprises electrostatically flocked short fibers on a sliding contact surface of the fixed blade.

10. The label issuing device according to claim 1, the oil retaining body of the fixed blade retains the anti-adhesive agent by capillary action.

* * * * *